US010260381B2

(12) United States Patent
Sugiura et al.

(10) Patent No.: US 10,260,381 B2
(45) Date of Patent: Apr. 16, 2019

(54) VARIABLE VALVE MECHANISM OF INTERNAL COMBUSTION ENGINE

(71) Applicant: OTICS CORPORATION, Nishio-shi (JP)

(72) Inventors: Akira Sugiura, Nishio (JP); Koki Yamaguchi, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 75 days.

(21) Appl. No.: 15/655,680

(22) Filed: Jul. 20, 2017

(65) Prior Publication Data

US 2018/0045083 A1 Feb. 15, 2018

(30) Foreign Application Priority Data

Aug. 9, 2016 (JP) ..... 2016-156586

(51) Int. Cl.

| | |
|---|---|
| ***F01L 1/18*** | (2006.01) |
| ***F01L 1/20*** | (2006.01) |
| ***F01L 1/047*** | (2006.01) |
| ***F01L 1/08*** | (2006.01) |
| ***F01L 1/26*** | (2006.01) |
| *F01L 1/053* | (2006.01) |
| *F01L 1/46* | (2006.01) |

(52) U.S. Cl.

CPC ..... *F01L 1/20* (2013.01); *F01L 1/047* (2013.01); *F01L 1/08* (2013.01); *F01L 1/18* (2013.01); *F01L 1/185* (2013.01); *F01L 1/267* (2013.01); *F01L 1/053* (2013.01); *F01L 2001/186* (2013.01); *F01L 2001/467* (2013.01); *F01L 2105/00* (2013.01)

(58) Field of Classification Search

CPC F01L 2001/186; F01L 1/267; F01L 2001/467
USPC ..... 123/90.36, 90.44
See application file for complete search history.

(56) References Cited

U.S. PATENT DOCUMENTS

2010/0307434 A1* 12/2010 Odell ..... F01L 1/185 123/90.15
2012/0055428 A1* 3/2012 Kidooka ..... F01L 1/185 123/90.16

FOREIGN PATENT DOCUMENTS

JP S 62-203913 A 9/1987
JP 2006-132378 A 5/2006

* cited by examiner

*Primary Examiner* — Jorge Leon, Jr.
(74) *Attorney, Agent, or Firm* — McGinn I. P. Law Group, PLLC.

(57) ABSTRACT

A variable valve mechanism includes a rocker arm including a first input arm, a second input arm, and an output arm, and a switch device that switches an operating state to a first state by coupling only the first input arm to the output arm, and switches the operating state to a second state by coupling only the second input arm to the output arm. The switch device includes two pins that are displaceably placed in the rocker arm and contact each other at their end faces, and a displacement device that switches the operating state to the first state by displacing a contact portion between the two pins to between the output arm and the second input arm, and switches the operating state to the second state by displacing the contact portion between the two pins to between the output arm and the first input arm.

6 Claims, 8 Drawing Sheets

VARIABLE VALVE MECHANISM OF INTERNAL COMBUSTION ENGINE

TECHNICAL FIELD

The present invention relates to variable valve mechanisms that drive a valve of an internal combustion engine and change the drive state of the valve according to the operating condition of the internal combustion engine.

BACKGROUND ART

A variable valve mechanism 90 of a first conventional example (Patent Document 1) shown in FIG. 6 includes a first arm 93 and a second arm 94. The first arm 93 is driven by a first cam 91 to drive a valve 7, and the second arm 94 is driven by a second cam 92. The operating state of the variable valve mechanism 90 is switched to a second state by coupling the second arm 94 to the first arm 93, and is switched to a first state by decoupling the second arm 94 from the first arm 93. The first state is the state where the valve 7 is driven according to the profile of the first cam 91, and the second state is the state where the valve 7 is driven according to the profile of the second cam 92.

A variable valve mechanism 100 of a second conventional example (Patent Document 2) shown in FIGS. 7A and 7B includes a first input arm 103, a second input arm 104, and an output arm 105. The first input arm 103 is driven by a first cam, and the second input arm 104 is driven by a second cam. The output arm 105 is placed between the first input arm 103 and the second input arm 104, and drives a valve when swinging. The operating state of the variable valve mechanism 100 is switched to a first state by coupling only the first input arm 103 out of the first and second input arms 103, 104 to the output arm 105, and is switched to a second state by coupling only the second input arm 104 out of the first and second input arms 103, 104 to the output arm 105. The first state is the state where the valve is driven according to the profile of the first cam, and the second state is the state where the valve is driven according to the profile of the second cam.

CITATION LIST

Patent Document

[Patent Document 1] Japanese Patent Application Publication No. 2006-132378

[Patent Document 2] Japanese Patent Application Publication No. S62-203913

SUMMARY OF INVENTION

Technical Problem

For example, in recent variable valve mechanisms, the first state is often used to provide desired performance, whereas the second state is often used in the Atkinson cycle in which fuel efficiency is prioritized. A high valve lift and a narrow action angle are desired in the first state, and a low valve lift and a wide action angle are desired in the second state.

In the first conventional example, the second arm 94 that is driven by the second cam 92 is coupled to the first arm 93 that is driven by the first cam 91. Accordingly, as shown in FIG. 8A, a lift curve C2 in the second state need always be larger than a lift curve C1 in the first state, and the lift curve C2 in the second state is excessively large, which results in reduced fuel efficiency in the second state.

In the second conventional example, one of the first and second input arms 103, 104 is selectively coupled to the output arm 105. Accordingly, as shown in FIG. 8B, a lift curve C1 in the first state can be made to cross a lift curve C2 in the second state, and fuel efficiency in the second state is not reduced. In the second conventional example, however, as shown in FIG. 7A, the operating state of the variable valve mechanism 100 is switched to the first state by displacing a contact portion (i.e., contact plane) T2 between a middle pin 115 and a pin 114 on the second input arm 104 side out of three pins 113, 114, 115 to between the output arm 105 and the second input arm 104. As shown in FIG. 7B, the operating state of the variable valve mechanism 100 is switched to the second state by displacing a contact portion T1 between the middle pin 115 and the pin 113 on the first input arm 103 side to between the output arm 105 and the first input arm 103. The three pins 113, 115, 114 are therefore required for the variable valve mechanism 100. This increases the number of components and also increases the overall lateral dimension of a rocker arm formed by the three arms 103, 105, 104.

It is an object of the present invention to implement the configuration in which lift curves cross each other, namely the configuration in which one of first and second input arms is selectively coupled to an output arm, with two pins.

Solution to Problem

In order to achieve the above object, a variable valve mechanism of an internal combustion engine according to the present invention includes a rocker arm including a first input arm that swings when driven by a first cam, a second input arm that swings when driven by a second cam, and an output arm that is disposed between the first input arm and the second input arm and that drives a valve when swinging, and a switch device that switches an operating state of the variable valve mechanism to a first state by coupling only the first input arm out of the first and second input arms to the output arm, and switches the operating state of the variable valve mechanism to a second state by coupling only the second input arm out of the first and second input arms to the output arm. The first state is a state where the valve is driven according to a profile of the first cam, and the second state is a state where the valve is driven according to a profile of the second cam.

The variable valve mechanism of the internal combustion engine of the present invention has the following characteristics. The switch device includes two pins that are displaceably placed in the rocker arm and contact each other at their end faces, and a displacement device that switches the operating state to the first state by displacing a contact portion between the two pins to between the output arm and the second input arm, and switches the operating state to the second state by displacing the contact portion between the two pins to between the output arm and the first input arm.

Advantageous Effects of Invention

According to the present invention, the configuration in which one of the first and second input arms is selectively coupled to the output arm can be implemented with the two pins.

DESCRIPTION OF EMBODIMENTS

Figure 1:
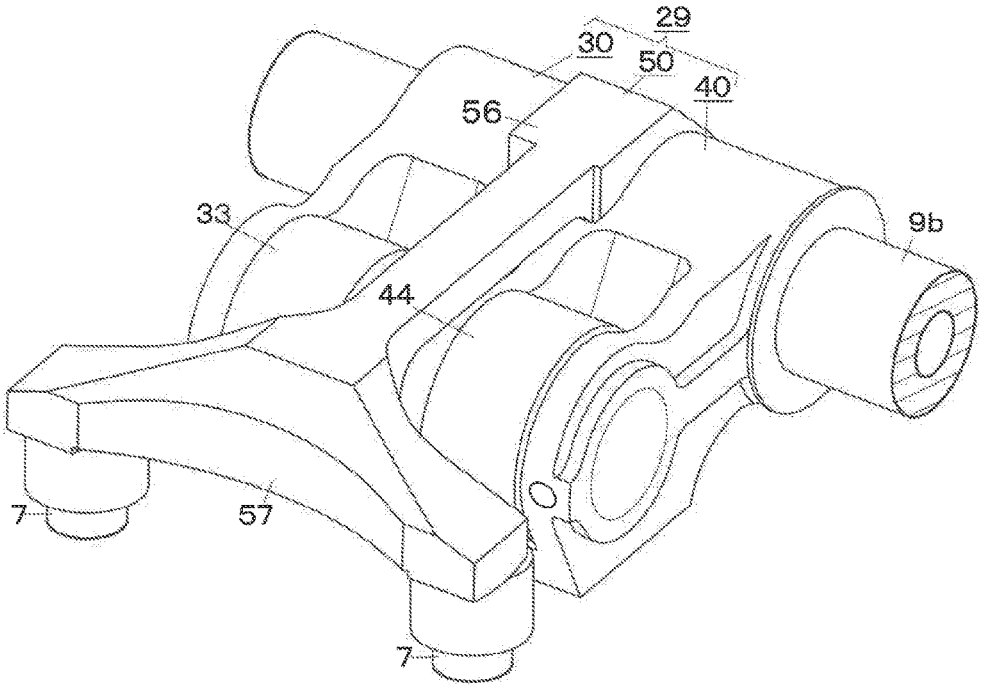
FIG. 1 is a perspective view of a variable valve mechanism of a first embodiment.

For example, the output arm is configured in the following form, although the configuration of the output arm is not particularly limited to this.

(i) The output arm has a through hole in which an end of one of the two pins is selectively inserted. The operating state is switched from one of the first and second states to the other when the contact portion between the two pins is displaced from one side of the through hole to the other side of the through hole through the through hole.

(ii) The output arm has a projection that is selectively contacted by a side surface of the end of one of the two pins. The operating state is switched from one of the first and second states to the other when the contact portion between the two pins is displaced from one side in a lateral direction of the projection to the other side in the lateral direction of the projection by passing above or below the projection.

It is preferable that a distance from between the output arm and the first input arm to between the output arm and the second input arm in a portion where the two pins are placed be 1 to 5 mm, although the present invention is not particularly limited to this. If the distance is larger than 5 mm, a stroke of the two pins may inevitably become too large. If the distance is smaller than 1 mm, the width (thickness) of the output arm may become too small, and sufficient strength may not be ensured. For similar reasons, the distance is more preferably 2 to 4 mm, and even more preferably 2.5 to 3.5 mm.

First Embodiment

An embodiment of the present invention will be described below. However, the present invention is not limited to this embodiment, and the configuration and shape of each part may be modified as desired without departing from the spirit and scope of the invention.

A variable valve mechanism 1 of a first embodiment shown in FIGS. 1 to 5 is a mechanism that opens and closes valves 7 by periodically pressing the valves 7 each having a valve spring 8 attached thereto. The variable valve mechanism 1 includes a first cam 10, a second cam 20, a rocker arm 29, and a switch device 60.

[First Cam 10]

Figure 2:
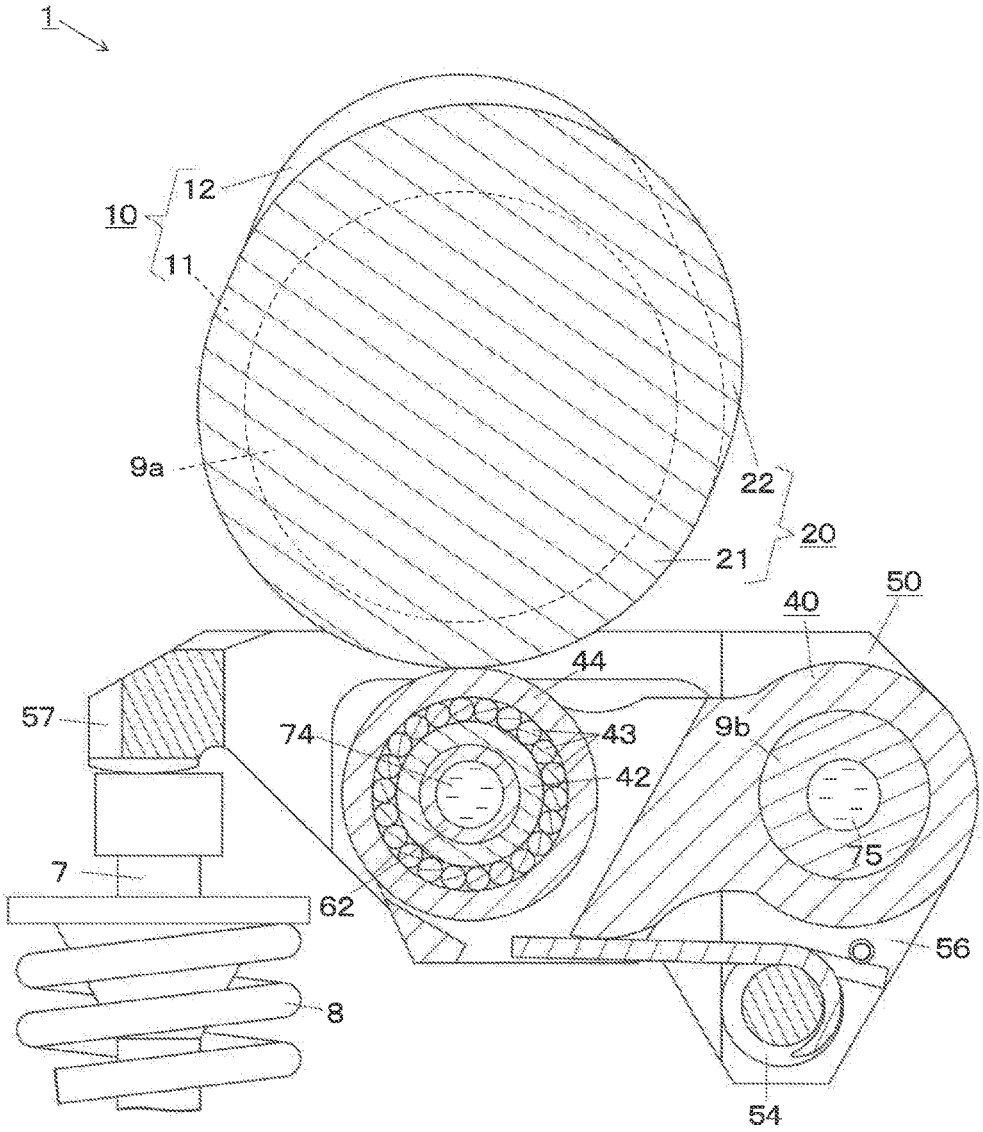
FIG. 2 is a side sectional view of the variable valve mechanism (taken along line II-II in FIG. 3A)

As shown in FIG. 2 etc., the first cam 10 is disposed on a camshaft 9*a* so as to project from the camshaft 9*a*. The camshaft 9*a* makes one full rotation for every two full rotations of an internal combustion engine. The first cam 10 includes a first base circle 11 and a first nose 12. The first base circle 11 has a circular shape as viewed from the side, and the first nose 12 projects from the first base circle 11.

[Second Cam 20]

The second cam 20 is disposed on the camshaft 9*a* at a position next to the first cam 10 so as to project from the camshaft 9*a*. The second cam 20 includes a second base circle 21 and a second nose 22. The second base circle 21 has a circular shape as viewed from the side, and the second nose 22 projects from the second base circle 21. The profile of the second nose 22 crosses the profile of the first nose 12.

[Rocker Arm 29]

As shown in FIG. 1 etc., the rocker arm 29 includes a first input arm 30, a second input arm 40, and an output arm 50.

Figure 3A:
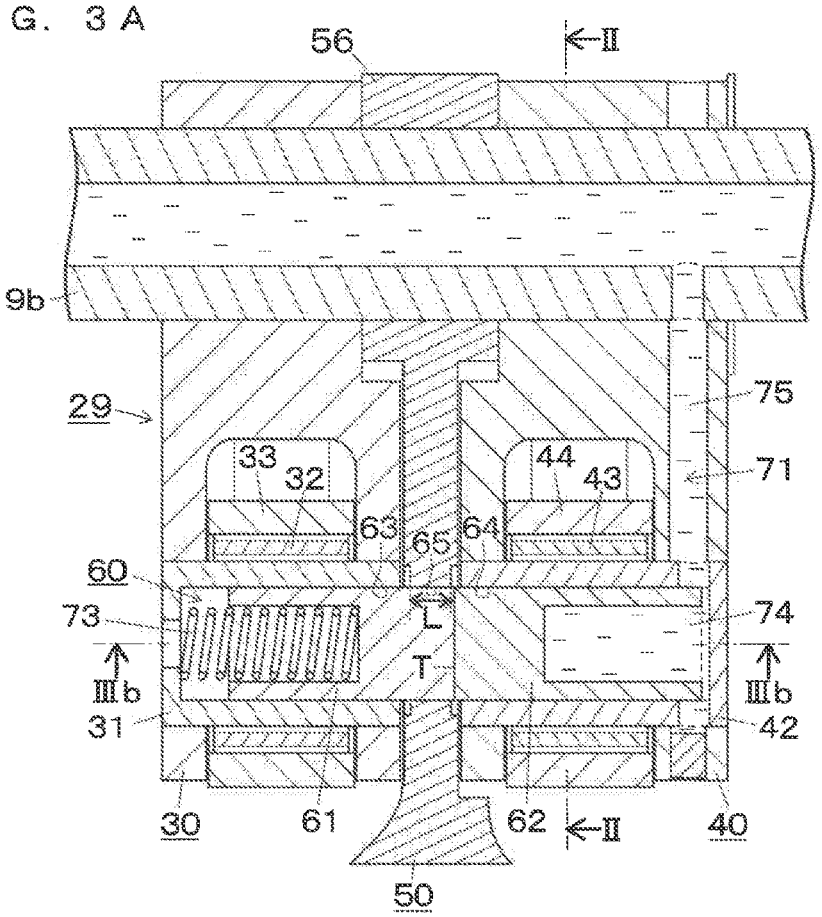
FIG. 3A is a top sectional view of the variable valve mechanism (taken along line IIIa-IIIa in FIG. 3B)
Figure 3B:
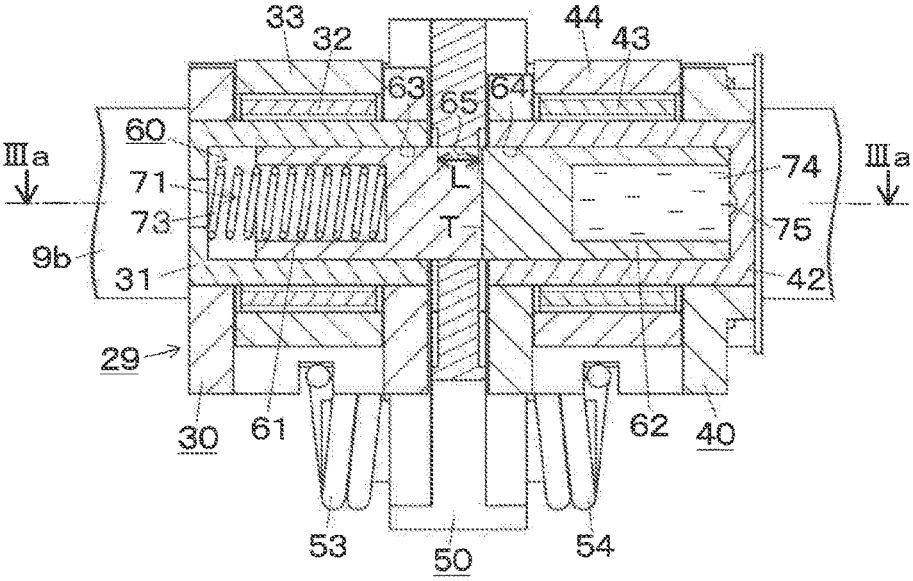
FIG. 3B is a front sectional view of the variable valve mechanism (taken along line IIIb-IIIb in FIG. 3A)

As shown in FIGS. 3A and 3B etc., the first input arm 30 is swingably supported at its rear end by a rocker shaft 9*b*. The first input arm 30 swings when driven by the first cam 10. The first input arm 30 has a first roller 33 attached to its tip end so that the first roller 33 contacts the first cam 10 and can rotate via a first shaft 31 and a bearing 32.

The second input arm 40 is swingably supported at its rear end by the rocker shaft 9*b*. The second input arm 40 swings when driven by the second cam 20. The second input arm 40 has a second roller 44 attached to its tip end so that the second roller 44 contacts the second cam 20 and can rotate via a second shaft 42 and a bearing 43.

The output arm 50 is formed by a base portion 56 and a tip portion 57 and has a T-shape as viewed in plan. The base portion 56 has an elongated shape that is long in the longitudinal direction, and is interposed between the first input arm 30 and the second input arm 40. The tip portion 57 extends from the tip end of the base portion 56 toward both sides in the lateral direction. The output arm 50 is swingably supported at the rear end of the base portion 56 by the rocker shaft 9*b*. When the output arm 50 swings, the output arm 50 drives the two valves 7, namely the right and left valves 7, with the tip portion 57. A first lost motion spring 53 and a second lost motion spring 54 are attached to the side surfaces of the base portion 56 of the output arm 50. The first lost motion spring 53 is a spring that causes the first input arm 30 to swing relative to the output arm 50 when in a second state. The first lost motion spring 53 biases the first input arm 30 toward the first cam 10. The second lost motion spring 54 is a spring that causes the second input arm 40 to swing relative to the output arm 50 when in a first state. The second lost motion spring 54 biases the second input arm 40 toward the second cam 20.

[Switch Device 60]

The switch device 60 is a device that switches the operating state of the variable valve mechanism 1 between the first and second states. The first state is the state where only the first input arm 30 out of the first and second input arms 30, 40 is coupled to the output arm 50 to drive the valves 7 according to the profile of the first cam 10. The second state is the state where only the second input arm 40 out of the first and second input arms 30, 40 is coupled to the output arm 50 to drive the valves 7 according to the profile of the second cam 20. The switch device 60 includes a first hole 63, a second hole 64, a through hole 65, a first pin 61, a second pin 62, and a displacement device 71.

The first hole 63 is a bottomed cylindrical hole formed in the first shaft 31 and opens toward the output arm 50. The second hole 64 is a bottomed cylindrical hole formed in the second shaft 42 and opens toward the output arm 50. The through hole 65 is a hole formed in the output arm 50 and opens toward the first input arm 30 and the second input arm 40.

The first pin 61 is displaceably placed in the first hole 63. The second pin 62 is displaceably placed in the second hole 64. These two pins 61, 62 are in contact with each other at their end faces. An end of one of the two pins 61, 62 is selectively inserted in the through hole 65.

The displacement device 71 includes a hydraulic chamber 74, an oil passage 75, and a return spring 73. The hydraulic chamber 74 is located in the second hole 64 and hydraulically presses the second pin 62 toward the first input arm 30. The oil passage 75 is an oil passage that supplies oil to the hydraulic chamber 74. The oil passage 75 extends from a cylinder head to the hydraulic chamber 74 through the rocker shaft 9*b* and the second input arm 40. The return spring 73 is disposed in the first hole 63 and elastically biases the first pin 61 toward the second input arm 40.

Figure 4A:
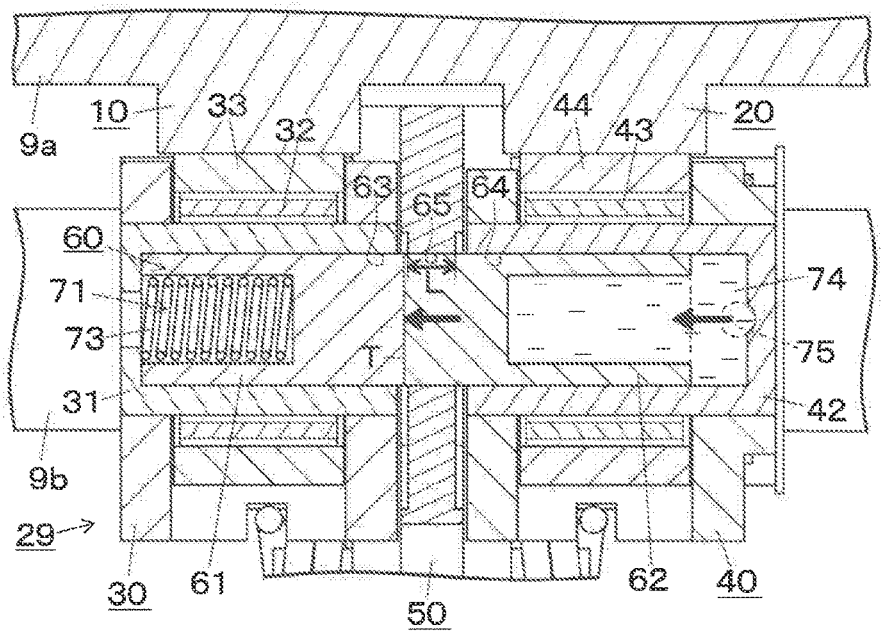
FIG. 4A is atop sectional view showing the operating state of the variable valve mechanism having been switched from a first state to a second state.
Figure 4B:
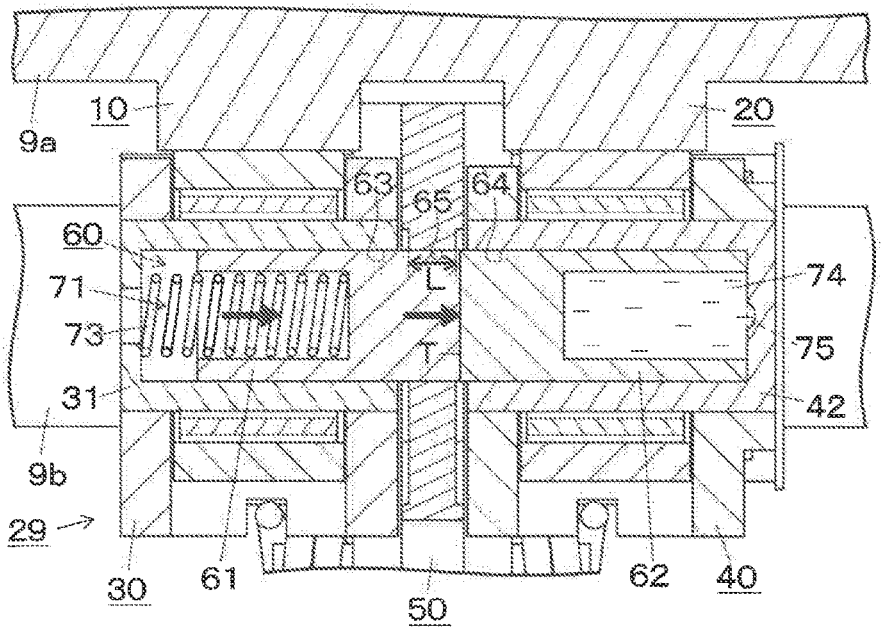
FIG. 4B is a top sectional view showing the operating state of the variable valve mechanism having been switched from the second state to the first state.

As shown in FIG. 4A, the displacement device 71 switches the operating state of the variable valve mechanism 1 from the first state to the second state by increasing the oil pressure in the hydraulic chamber 74 to displace the contact portion T between the two pins 61, 62 from between the output arm 50 and the second input arm 40 to between the output arm 50 and the first input arm 30. As shown in FIG. 4B, the displacement device 71 switches the operating state of the variable valve mechanism 1 from the second state to the first state by reducing the oil pressure in the hydraulic chamber 74 to displace the contact portion T between the two pins 61, 62 from between the output arm 50 and the first input arm 30 to between the output arm 50 and the second input arm 40 by using the elastic force of the return spring 73.

Specifically, the operating state of the variable valve mechanism 1 is switched from one of the first and second states to the other when the contact portion T between the two pins 61, 62 is displaced from one side of the through hole 65 to the other side of the through hole 65 through the through hole 65. The length L of the through hole 65 (i.e., the distance from between the output arm 50 and the first input arm 30 to between the output arm 50 and the second input arm 40) is about 3 mm. The stroke of the two pins 61, 62 and the contact portion T is approximately the same as the length L of the through hole 65 (to be exact, slightly larger than the length L of the through hole 65).

Figure 5:
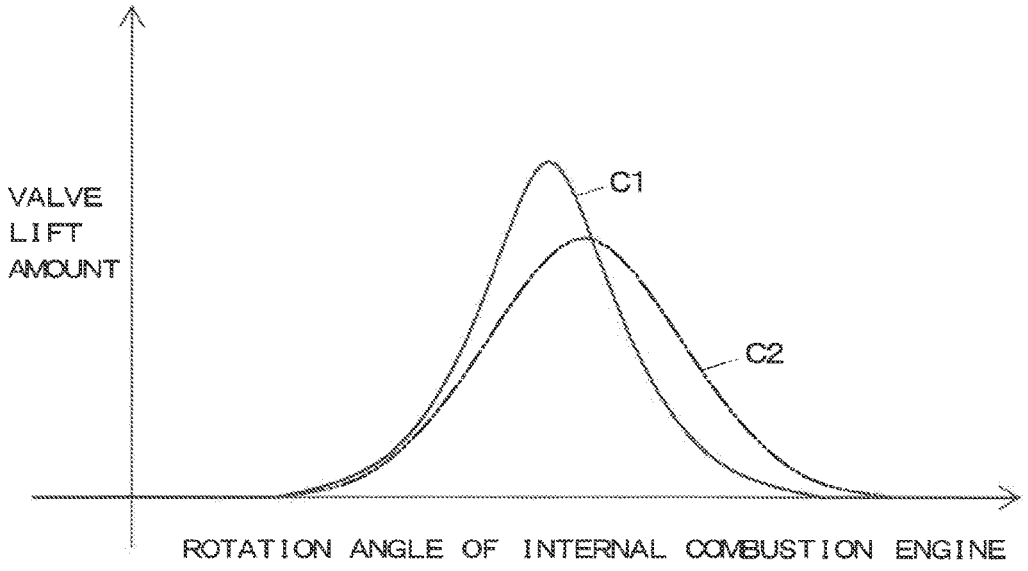
FIG. 5 is a graph showing lift curves of the variable valve mechanism.
Figure 6:
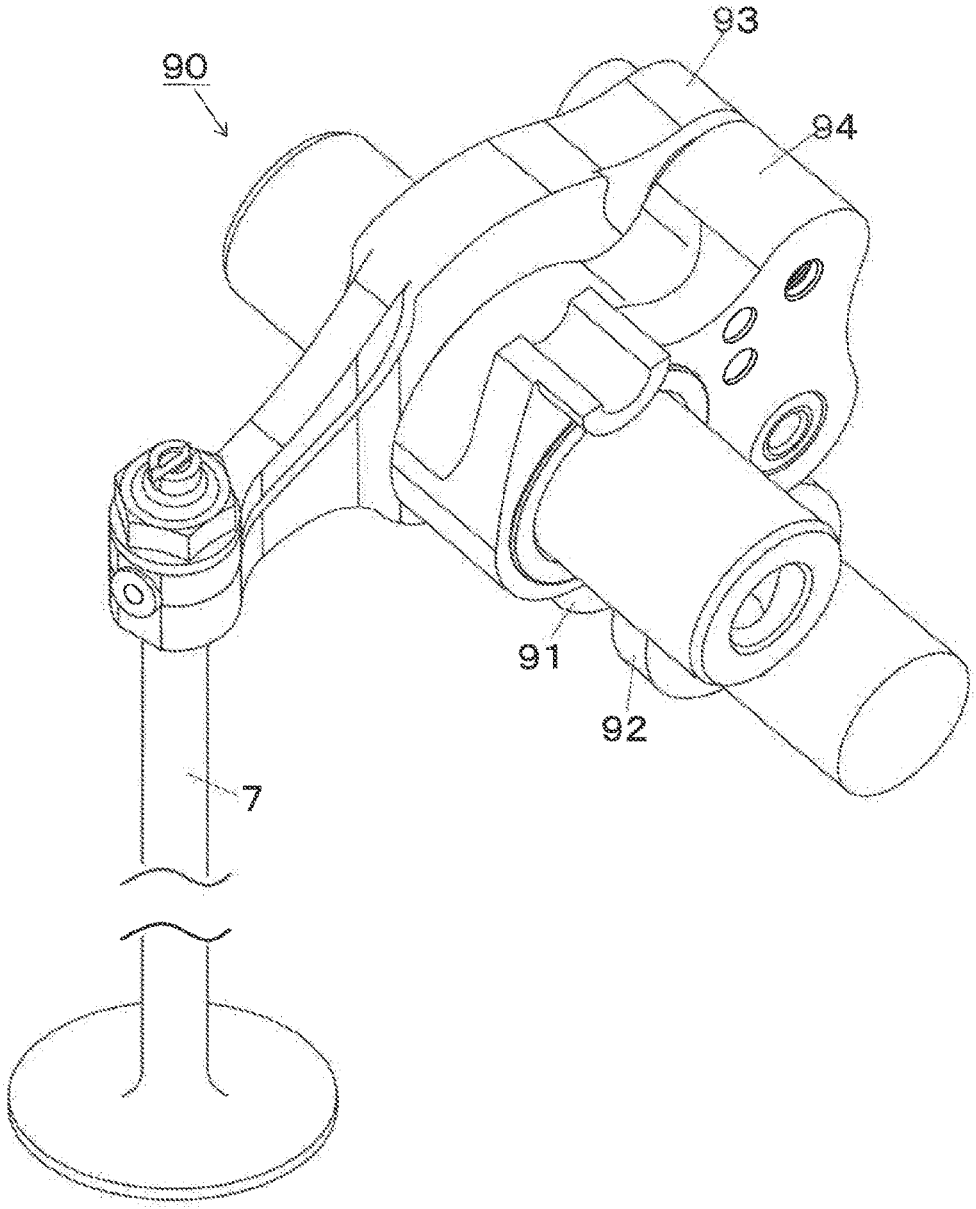
FIG. 6 PRIOR ART
FIG. 6 is a perspective view of a variable valve mechanism of a first conventional example.
Figure 7A:
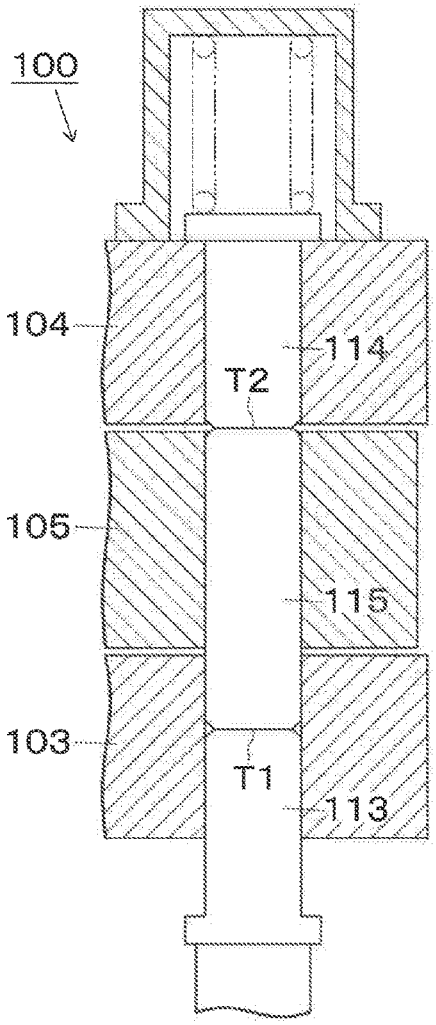
FIG. 7A PRIOR ART
FIG. 7A is atop sectional view showing the operating state of a variable valve mechanism of a second conventional example having been switched to a first state.
Figure 7B:
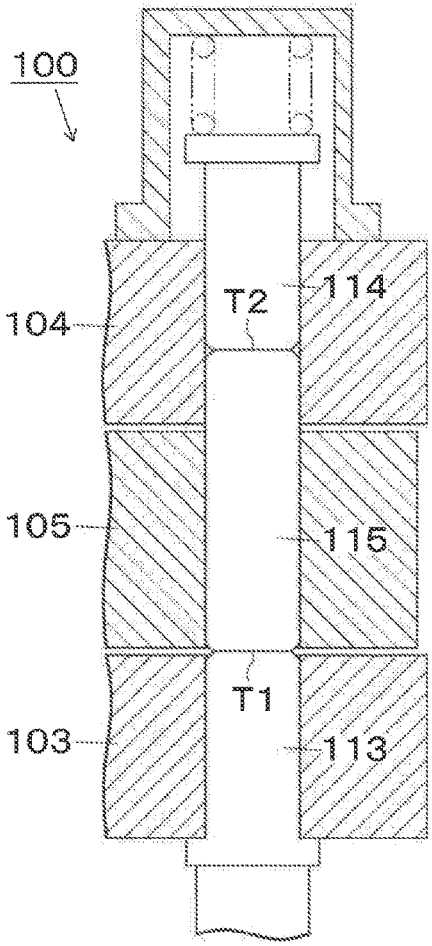
FIG. 7B PRIOR ART
FIG. 7B is a top sectional view showing the operating state of the variable valve mechanism of the second conventional example having been switched to the second state.
Figure 8A:
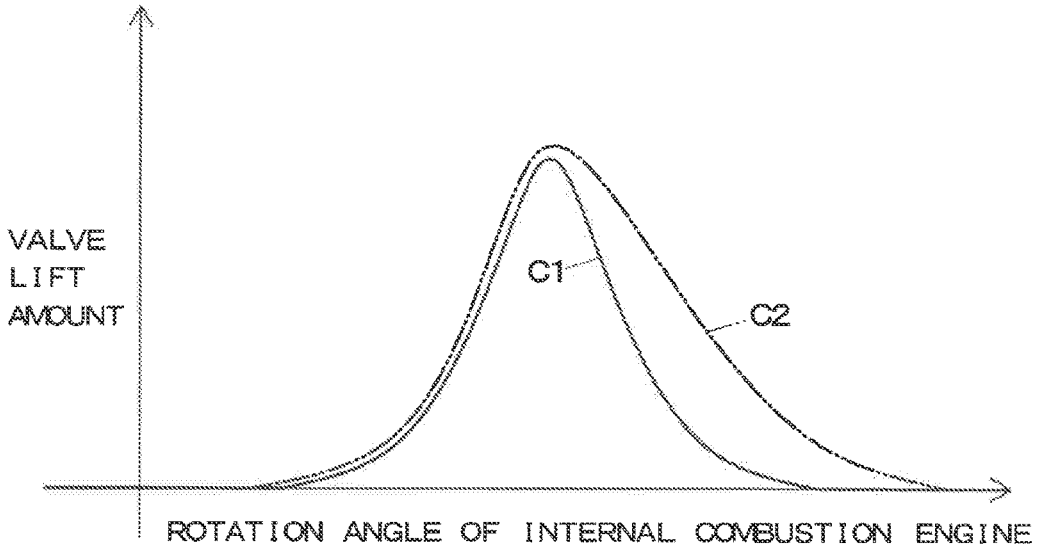
FIG. 8A PRIOR ART
FIG. 8A is a graph showing lift curves of the first conventional example.
Figure 8B:
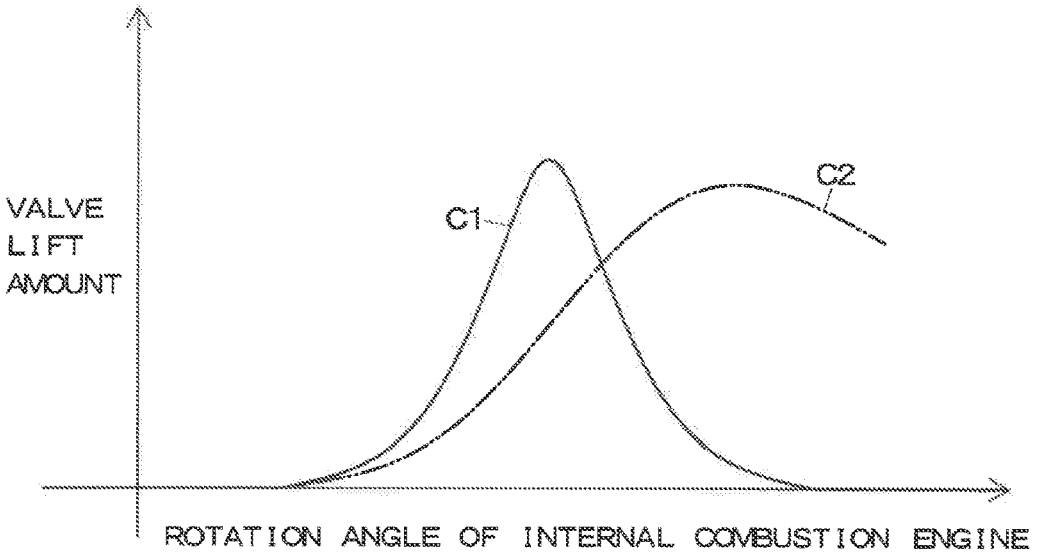
FIG. 8B PRIOR ART
FIG. 8B is a graph showing lift curves of the second conventional example.

As shown in FIG. 5, a first lift curve C1 crosses a second lift curve C2. The first lift curve C1 is a lift curve (the valve lift amount with respect to the rotation angle of the internal combustion engine) in the first state, and the second lift curve C2 is a lift curve in the second state.

The present invention has the following effects.

[A] In the first state, the second input arm 40 is decoupled from the output arm 50. In the second state, the first input arm 30 is decoupled from the output arm 50. Accordingly, the first lift curve C1 and the second lift curve C2 can be made to cross each other as described above. Improved flexibility in design of the lift curves C1, C2 can thus be achieved, which leads to improved fuel efficiency.

[B] The configuration in which one of the first and second input arms 30, 40 is selectively coupled to the output arm 50 can be implemented with the two pins 61, 62. This can reduce the number of components and simplify the variable valve mechanism 1, and can also reduce the lateral dimension of the rocker arm 29.

REFERENCE SIGNS LIST

1 Variable valve mechanism (first embodiment)
7 Valve
10 First cam
20 Second cam
29 Rocker arm
30 First input arm
40 Second input arm
50 Output arm
60 Switch device
61 First pin
62 Second pin
65 Through hole
71 Displacement device
T Contact portion between two pins
L Length of through hole

The invention claimed is:

1. A variable valve mechanism of an internal combustion engine comprising:

a rocker arm including a first input arm that swings when driven by a first cam, a second input arm that swings when driven by a second cam, and an output arm that is disposed between the first input arm and the second input arm and that drives a valve when swinging; and a switch device that switches an operating state of the variable valve mechanism to a first state by coupling only the first input arm out of the first and second input arms to the output arm, and switches the operating state of the variable valve mechanism to a second state by coupling only the second input arm out of the first and second input arms to the output arm, the first state being a state where the valve is driven according to a profile of the first cam, and the second state being a state where the valve is driven according to a profile of the second cam, wherein the switch device includes:

two pins displaceably placed in the rocker arm, the two pins contacting each other at end faces thereof forming a contact plane; and a displacement device that switches the operating state to the first state by displacing the contact plane to be between the output arm and the second input arm, and switches the operating state to the second state by displacing the contact plane to be between the output arm and the first input arm.

2. The variable valve mechanism of an internal combustion engine according to claim 1, wherein the output arm has a through hole in which an end of one of the two pins is selectively inserted, and the operating state is switched between the first and second states when the contact plane between the two pins is displaced from one side of the through hole to an other side of the through hole through the through hole.

3. The variable valve mechanism of an internal combustion engine according to claim 2, wherein a displacement stroke of the contact plane when the operating state is switched between the first and second states is 1 mm to 5 mm.

4. The variable valve mechanism of an internal combustion engine according to claim 2, wherein the first input arm is swingably supported at rear end thereof by a rocker shaft, the second input arm is swingably supported at rear end thereof by the rocker shaft, the output arm has a T-shape as viewed in plan and includes:

a base portion that has an elongated shape that is long in a longitudinal direction, and is interposed between the first input arm and the second input arm; and a tip portion that extends from a tip end of the base portion toward the first and second input arms in a lateral direction, the output arm is swingably supported at a rear end of the base portion by the rocker shaft, has the through hole in an intermediate part of the base portion, and the valve includes two valves and the output arm drives the two valves with the tip portion.

5. The variable valve mechanism of an internal combustion engine according to claim 1, wherein a displacement stroke of the contact plane when the operating state is switched between the first and second states is 1 mm to 5 mm.

6. The variable valve mechanism of an internal combustion engine according to claim 1, comprising:

a first lost motion spring that causes the first input arm to swing relative to the output arm when in the second state; and a second lost motion spring that causes the second input arm to swing relative to the output arm when in the first state, wherein the first and second lost motion springs are attached to side surfaces of a base portion of the output arm.

* * * * *